US009163576B2

(12) United States Patent
Sherwin et al.

(10) Patent No.: US 9,163,576 B2
(45) Date of Patent: Oct. 20, 2015

(54) SYSTEM AND METHOD FOR CALIBRATING ENGINE CRANKSHAFT-CAMSHAFT CORRELATION AND FOR IMPROVED VEHICLE LIMP-HOME MODE

(75) Inventors: Kevin A. Sherwin, Farmington Hills, MI (US); Anthony L. Marks, Novi, MI (US); Robert J. Horner, Dexter, MI (US); Wenbo Wang, Novi, MI (US); Layne K. Wiggins, Dexter, MI (US); Antonio E. Bartolomeo, Warren, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1062 days.

(21) Appl. No.: 13/242,881

(22) Filed: Sep. 23, 2011

(65) Prior Publication Data

US 2013/0006496 A1 Jan. 3, 2013

Related U.S. Application Data

(60) Provisional application No. 61/502,010, filed on Jun. 28, 2011.

(51) Int. Cl.

| | |
|---|---|
| ***F02D 41/00*** | (2006.01) |
| ***F02D 41/22*** | (2006.01) |
| ***F02D 41/30*** | (2006.01) |
| ***F02P 7/067*** | (2006.01) |
| ***F02P 7/07*** | (2006.01) |
| *F02D 37/02* | (2006.01) |

(52) U.S. Cl.

CPC ..... *F02D 41/222* (2013.01); *F02D 41/009* (2013.01); *F02D 41/0097* (2013.01); *F02D 41/3005* (2013.01); *F02P 7/0675* (2013.01); *F02P 7/07* (2013.01); *F02D 37/02* (2013.01); *F02D 2041/227* (2013.01)

(58) Field of Classification Search

CPC . F02D 41/042; F02D 41/0087; F02D 41/123; Y02T 10/48; Y02T 10/18

USPC ..... 701/101, 102, 103, 104, 105, 110, 114, 701/115; 73/114; 123/196 DB

See application file for complete search history.

(56) References Cited

U.S. PATENT DOCUMENTS

| | | | | | |
|---|---|---|---|---|---|
| 5,289,805 | A | * | 3/1994 | Quinn et al. | 123/90.17 |
| 5,417,187 | A | * | 5/1995 | Meyer et al. | 123/90.17 |
| 5,463,898 | A | * | 11/1995 | Blander et al. | 73/114.63 |
| 5,469,823 | A | * | 11/1995 | Ott et al. | 123/406.62 |
| 5,609,126 | A | * | 3/1997 | Cullen et al. | 123/90.15 |
| 5,630,396 | A | * | 5/1997 | Fukui et al. | 123/406.18 |
| 5,671,145 | A | * | 9/1997 | Krebs et al. | 701/102 |
| 5,680,843 | A | * | 10/1997 | Bacon et al. | 123/406.62 |
| 5,715,780 | A | * | 2/1998 | Haller | 123/90.17 |

(Continued)

FOREIGN PATENT DOCUMENTS

CN 101469619 A 7/2009

*Primary Examiner* — Hai Huynh
*Assistant Examiner* — Raza Najmuddin

(57) ABSTRACT

A system for an engine includes an edge detection module and a correlation calibration module. The edge detection module (i) detects edges of a camshaft of the engine using a camshaft position sensor, and (ii) detects edges of a crankshaft of the engine using a crankshaft position sensor. The correlation calibration module calibrates a correlation between the crankshaft and the camshaft based on the detected edges of the crankshaft and the camshaft, respectively.

20 Claims, 7 Drawing Sheets

(56) References Cited

U.S. PATENT DOCUMENTS

| | | | | |
|---|---|---|---|---|
| 6,101,993 | A * | 8/2000 | Lewis et al. | 123/90.17 |
| 6,609,498 | B2 * | 8/2003 | Mathews et al. | 123/406.62 |
| 6,941,799 | B2 * | 9/2005 | McCabe | 73/114.26 |
| 7,661,297 | B2 * | 2/2010 | Steinruecken et al. | 73/114.27 |
| 7,757,546 | B2 * | 7/2010 | Gray et al. | 73/114.26 |
| 8,249,796 | B2 * | 8/2012 | Rollinger et al. | 701/114 |
| 8,666,641 | B2 * | 3/2014 | Rollinger et al. | 701/114 |
| 2003/0111058 | A1 | 6/2003 | Mathews | |
| 2009/0165542 | A1 | 7/2009 | Gray et al. | |
| 2011/0144883 | A1 * | 6/2011 | Rollinger et al. | 701/102 |

* cited by examiner

SYSTEM AND METHOD FOR CALIBRATING ENGINE CRANKSHAFT-CAMSHAFT CORRELATION AND FOR IMPROVED VEHICLE LIMP-HOME MODE

CROSS-REFERENCE TO RELATED APPLICATIONS

This application claims the benefit of U.S. Provisional Application No. 61/502,010, filed on Jun. 28, 2011. The disclosure of the above application is incorporated herein by reference in its entirety.

FIELD

The present disclosure relates to internal combustion engines and more particularly to a system and method for calibrating engine crankshaft-camshaft correlation and for improved vehicle limp-home mode.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines draw air into an intake manifold through an induction system that may be regulated by a throttle. The air in the intake manifold is distributed to a plurality of cylinders and mixed with fuel to create an air/fuel (A/F) mixture. The plurality of cylinders may include a plurality of intake valves, respectively. The intake valves may be opened and closed by a camshaft thereby controlling the flow of air (or A/F mixture) into the cylinders. The A/F mixture is compressed and combusted within the cylinders to drive pistons that rotatably turn a crankshaft and generate drive torque. The drive torque may then be transferred from the crankshaft to a driveline (e.g., wheels) to propel a vehicle.

SUMMARY

A system for an engine includes an edge detection module and a correlation calibration module. The edge detection module (i) detects edges of a camshaft of the engine using a camshaft position sensor, and (ii) detects edges of a crankshaft of the engine using a crankshaft position sensor. The correlation calibration module calibrates a correlation between the crankshaft and the camshaft based on the detected edges of the crankshaft and the camshaft, respectively.

A method for an engine includes detecting edges of a camshaft of the engine using a camshaft position sensor, detecting edges of a crankshaft of the engine using a crankshaft position sensor, and calibrating a correlation between the crankshaft and the camshaft based on the detected edges of the crankshaft and the camshaft, respectively.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
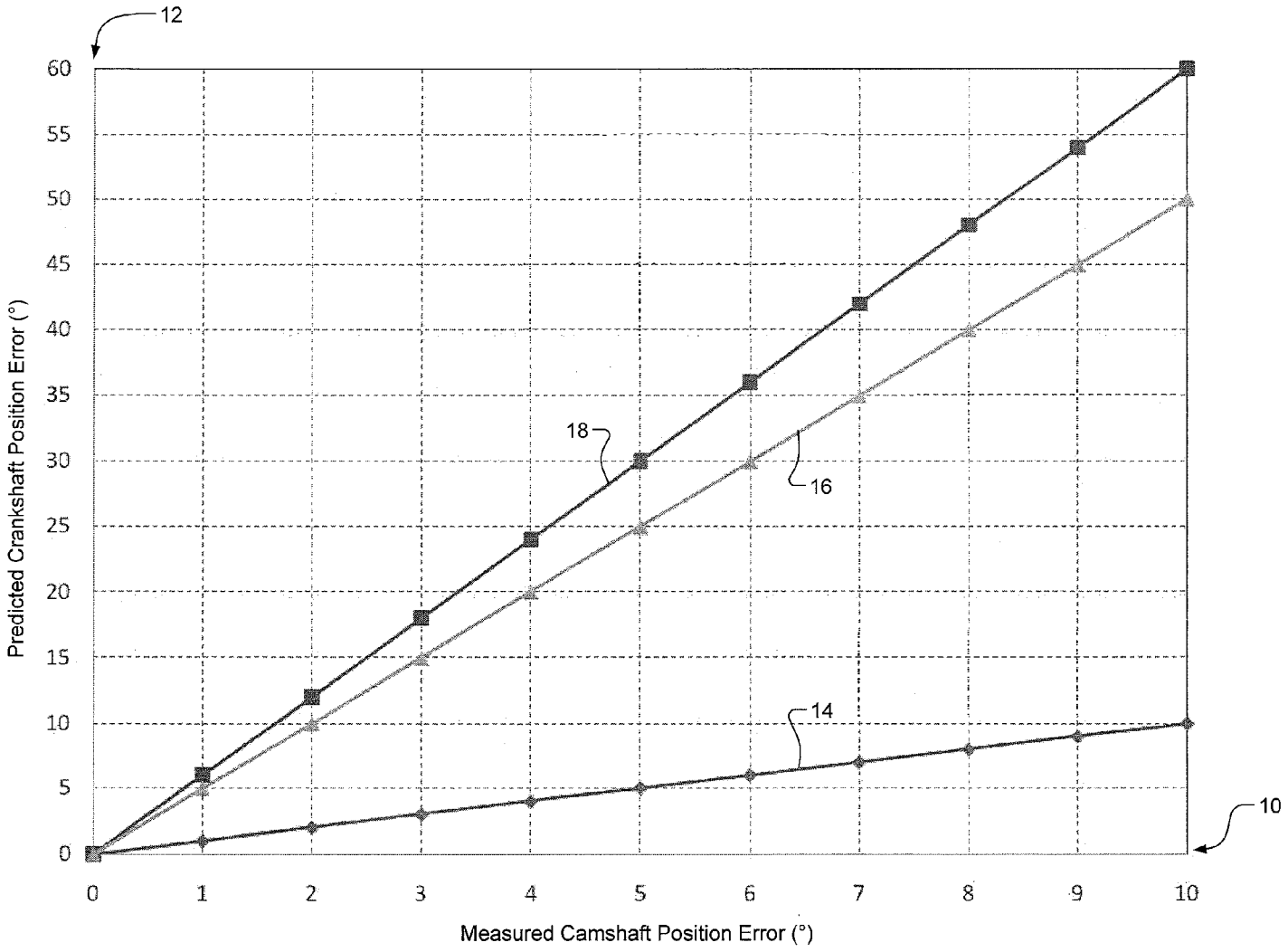
FIG. 1 is a graph illustrating predicted crankshaft position error caused by measured camshaft position error due to varying manufacturing tolerances.

The following description is merely illustrative in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors or a group of execution engines. For example, multiple cores and/or multiple threads of a processor may be considered to be execution engines. In various implementations, execution engines may be grouped across a processor, across multiple processors, and across processors in multiple locations, such as multiple servers in a parallel processing arrangement. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

A crankshaft position sensor measures a rotational position of a crankshaft of an engine. For example, the crankshaft position sensor may include a sensor that generates pulses corresponding to passing notches (or teeth) of a gear coupled to the crankshaft. Based on the measurements by the crankshaft position sensor, a control system may determine (i) a relative position of the crankshaft and/or (ii) a rotational speed of the crankshaft (engine speed). The control system may control fuel and/or spark supplied to the engine based on the measurements by the crankshaft position sensor. For example, a rate of fuel injection and/or spark frequency may be increased as the engine speed increases.

The crankshaft position sensor, however, may fail. Specifically, the crankshaft position sensor may stop transmitting the signal indicating the position/speed of the crankshaft. For example, electronics in the crankshaft position sensor may fail, connections can short or open, etc. In addition, the crankshaft position sensor failure may be caused by physical wear or damage due to exposure to extreme heat. Exposure to extreme heat may damage an ASIC in the sensor. Alternatively, for example, the failure of the crankshaft position sensor may be a result of a gasket leak, contaminated oil or other engine fluids, or merely wear over an extended period of time. A secondary or back-up crankshaft sensor may be implemented for instances when the crankshaft position sensor fails. Implementing an additional crankshaft position sensor, however, increases costs.

One or more camshafts of the engine may rotate in relation to the crankshaft. For example, the crankshaft gear may drive a timing belt which drives a gear coupled to the camshaft. The camshaft position, therefore, may be related to the crankshaft position. In addition, a camshaft position sensor measures a position/speed of the camshaft. Therefore, the camshaft position sensor may be used when the crankshaft position sensor has failed. More specifically, the camshaft position sensor may be used to predict the crankshaft position and thereby control fuel and/or spark delivery. Prediction of the crankshaft position based on the camshaft position, however, may merely be a temporary solution.

More specifically, the camshaft position-based prediction of crankshaft position may be used during a limp-home mode of the vehicle, thereby allowing a driver of the vehicle to get home (or to a service station). Predetermined (i.e., calibrated) values relating to the camshaft and camshaft position sensor may be stored and used by the control system. However, manufacturing tolerances may result in increased camshaft to crankshaft alignment variation. For example, the control system may be designed based on a predetermined camshaft design and/or orientation. In other words, the control system may measure the camshaft position with some degree of error (e.g., in degrees, or °), which in turn may result in an error in both predicted crankshaft position and an error in fuel or spark delivery.

The error in predicting crankshaft position based on measured camshaft position may be amplified for a plurality of reasons. First, the predicted crankshaft position error may be amplified due to mixing rising and falling camshaft edges with their respective errors. More specifically, the difference in sign of the rising camshaft edge error may be different than the sign of the falling camshaft edge error, thereby causing an increased predicted crankshaft position error when combined. Additionally, the predicted crankshaft position error may be amplified due to varying magnitudes of extrapolation distances. More specifically, extrapolating long intervals versus extrapolating short intervals may result in a multiplication factor (greater than one), thereby multiplying and thus increasing the predicted crankshaft position error.

Referring now to FIG. 1, a graph illustrates an example relationship between measured camshaft position error due to manufacturing tolerances and corresponding predicted crankshaft position error. A horizontal axis 10 represents measured camshaft position error. A vertical axis 12 represents predicted crankshaft position error. For example, the measured camshaft position error and/or predicted crankshaft position error may be in units of degrees (°).

A first line 14 represents an engine having dual camshafts having a first manufacturing variation. A second line 16 represents an engine having a single camshaft and the first manufacturing variation. A third line 18 represents an engine having dual camshafts but a second manufacturing variation different than the first manufacturing variation. As shown, the manufacturing differences causes a significant increase in predicted crankshaft position error as measured camshaft position error increases compared to both single and dual camshaft engines having other manufacturing variations.

Accordingly, a system and method are presented for calibrating engine crankshaft-camshaft correlation and for improved vehicle limp-home mode. The engine crankshaft-camshaft correlation may be calibrated when calibration is enabled (e.g., when learning conditions are met). Calibration of the engine crankshaft-camshaft correlation may include detecting edges of features on gears (i.e., notches or teeth) coupled to the crankshaft and camshaft, respectively, calibrating the engine crankshaft-camshaft correlation based on the detection, and storing the calibrated engine crankshaft-camshaft correlation for improved crankshaft position prediction during limp-home mode.

Therefore, the system and method may also detect a failure of a crankshaft position sensor. When the crankshaft position sensor has failed, the system and method command a limp-home mode for the vehicle. The system and method may control limp-home of a vehicle based on predicted crankshaft position. The system and method may predict the crankshaft position based on measured camshaft position (from the camshaft position sensor) and the calibrated engine crankshaft-camshaft correlation. More specifically, the system and method may control air, fuel, and/or spark during the limp-home mode by predicting crankshaft position based on measurements from the calibrated camshaft position sensor.

Figure 2:
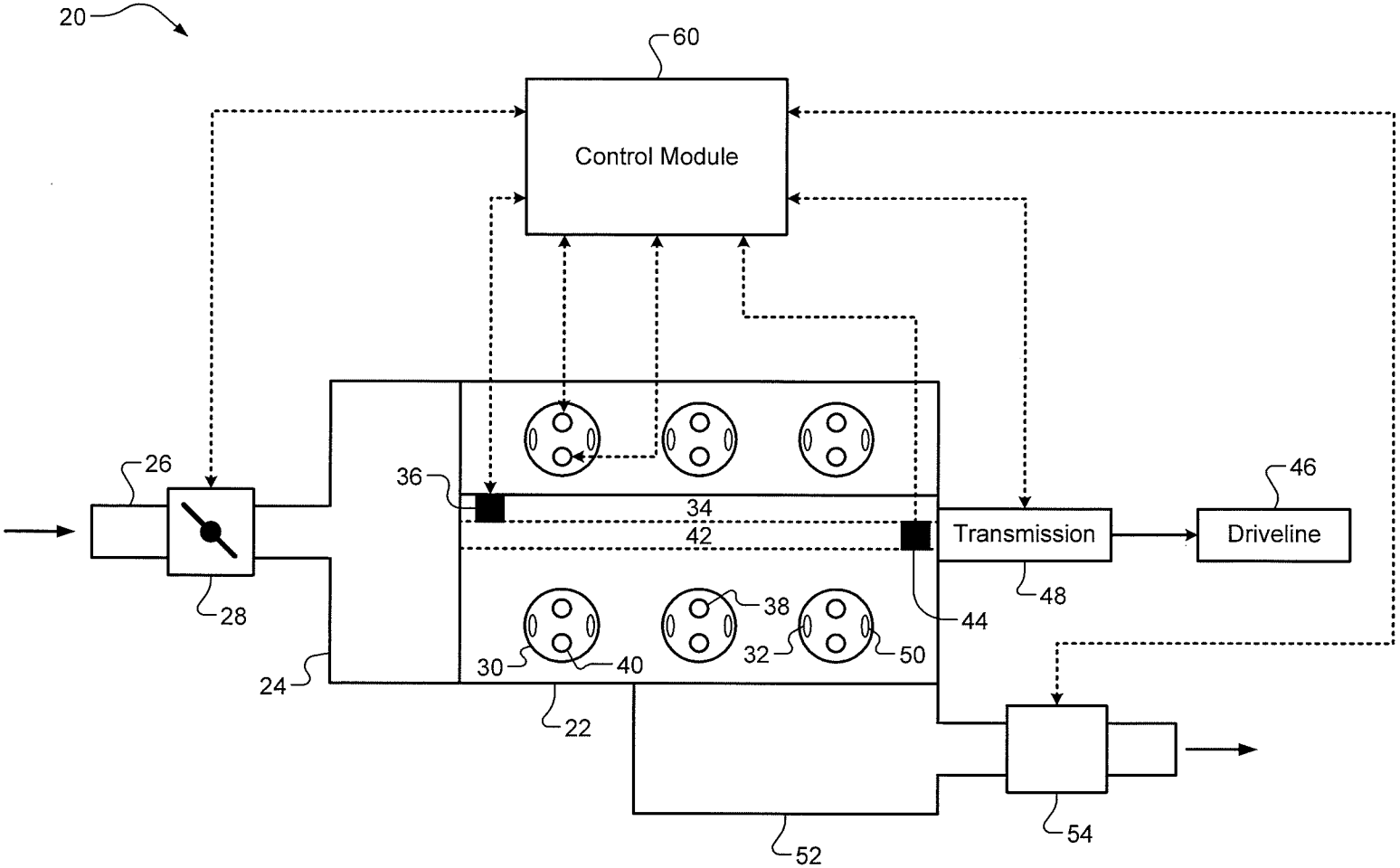
FIG. 2 is a functional block diagram of an example engine system according to some implementations of the present disclosure.

Referring now to FIG. 2, an engine system 20 includes an engine 22. The engine system 20 may be used to propel a vehicle. The engine 22 may include a spark-ignition (SI) engine, a diesel engine, a homogeneous charge compression ignition (HCCI) engine, or another suitable type of engine. The engine system 20 may be a hybrid system and therefore may include additional components such as an electric motor and a battery system.

The engine 22 draws air into an intake manifold 24 through an induction system 26 that may be regulated by a throttle 28. For example, the throttle 28 may be electrically controlled via electronic throttle control (ETC). The air in the intake manifold 24 is distributed to a plurality of cylinders 30 through a plurality of intake valves 32, respectively. While six cylinders are shown, the engine 22 may include other numbers of cylinders. The intake valves 32 may be actuated (i.e., open/closed) by a camshaft 34. While one camshaft 34 is shown, the engine 22 may include two or more camshafts (e.g., independent camshafts for intake and exhaust valves, respectively). A camshaft position sensor 36 measures a relative position of the camshaft 34.

The air is also combined with fuel from a plurality of fuel injectors 38 to create an air/fuel (A/F) mixture. The fuel injectors 38 may inject the fuel either via intake ports of the cylinders 30 (port fuel injection) or directly into the cylinders 30 (direct fuel injection). The A/F mixture is compressed within the cylinders 30 using pistons (not shown). The compressed A/F mixture is then ignited thereby driving the pistons upward. The compressed A/F mixture may be ignited via spark from a plurality of spark plugs 40, respectively. Depending on the type of engine 22, however, the A/F mixture may also be compressed until auto-ignition occurs.

The pistons rotatably turn a crankshaft 42 and generate drive torque. A crankshaft position sensor 44 measures a relative position of the crankshaft 42. For example, measurements from the crankshaft position sensor 44 may be used to determine engine speed (e.g., in revolutions per minute, or RPM). The drive torque is transferred from the crankshaft 42 to a driveline 46 of a vehicle via a transmission 48. More specifically, the transmission 48 may translate the drive torque at the crankshaft 42 to a desired torque at the driveline 46 using one of a plurality of gear ratios. The transmission 48 may be a manual transmission, an automatic transmission, a dual clutch transmission (DCT), or another suitable type of transmission. The transmission 48 may also be coupled to the crankshaft 42 via a fluid coupling such as a torque converter (not shown).

Exhaust gas resulting from combustion of the A/F mixture is expelled from the cylinders 30 through a plurality of exhaust valves 50 and into an exhaust manifold 52. The camshaft 34 may also actuate (i.e., open/close) the exhaust valves 50. As previously described, however, the engine 22 may include two or more independent camshafts for controlling the intake valves 32 and the exhaust valves 50, respectively. The exhaust gas in the exhaust manifold 52 is treated by an exhaust treatment system 54 before being released into the atmosphere. For example, the exhaust treatment system 54 may include a three-way catalytic converter and/or other suitable emissions system components.

A control module 60 controls operation of the engine system 20. The control module 60 may receive signals from the throttle 28, the camshaft position sensor 36, the fuel injectors 38, the spark plugs 40, the crankshaft position sensor 44, the transmission 48, and/or the exhaust treatment system 54. The control module 60 may control the throttle 28, the fuel injectors 38, the spark plugs 40, the transmission 48, and/or the exhaust treatment system 54. The control module 60 may also implement the system or method of the present disclosure.

Figure 3A:
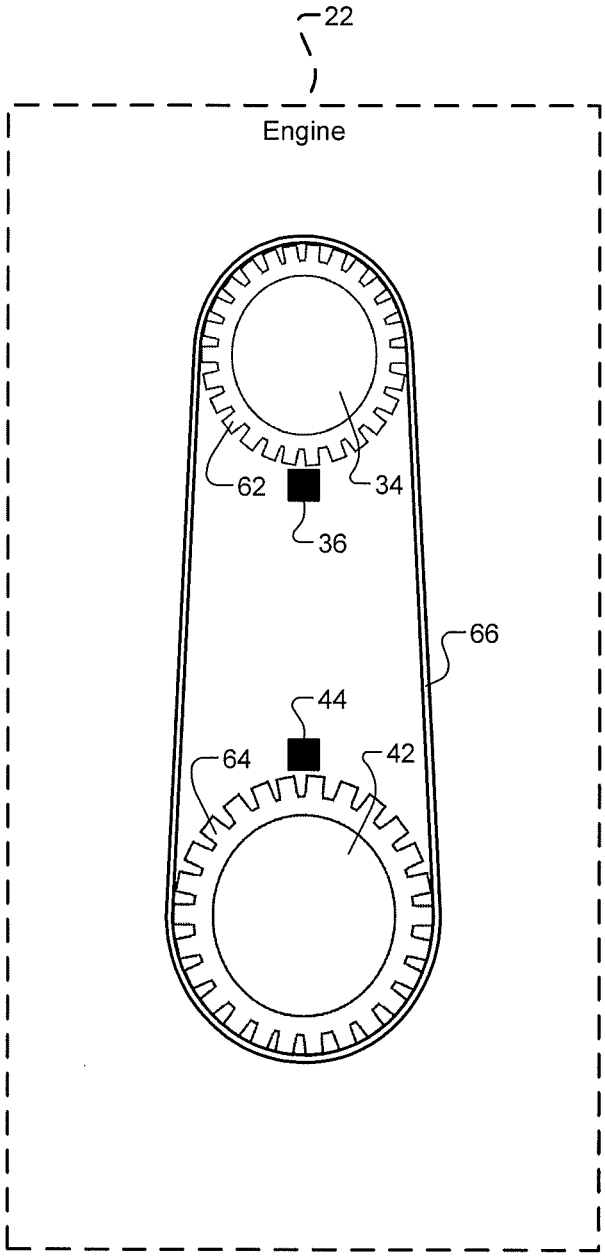
FIG. 3A is cross-sectional view of an example engine according to some implementations of the present disclosure.

Referring now to FIG. 3A, an example side view of the engine 22 is shown. As shown, the camshaft 34 and the crankshaft 42 may be rotatably connected. More specifically, the camshaft 34 may be coupled to a camshaft gear 62, the crankshaft 42 may be coupled to a crankshaft gear 64, and the camshaft gear 62 and the crankshaft gear 64 may be connected by a timing belt 66. Combustion within the engine 22 rotatably drives the crankshaft 42 which in turn rotatably drives both the crankshaft gear 64 and the timing belt 66. The crankshaft position sensor 44 measures the position of the crankshaft 42. The rotation of the timing belt 66 thereby rotatably drives the camshaft gear 62 which in turn rotatably drives the camshaft 34. The camshaft position sensor 36 measures the position of the camshaft 34.

Figure 3B:
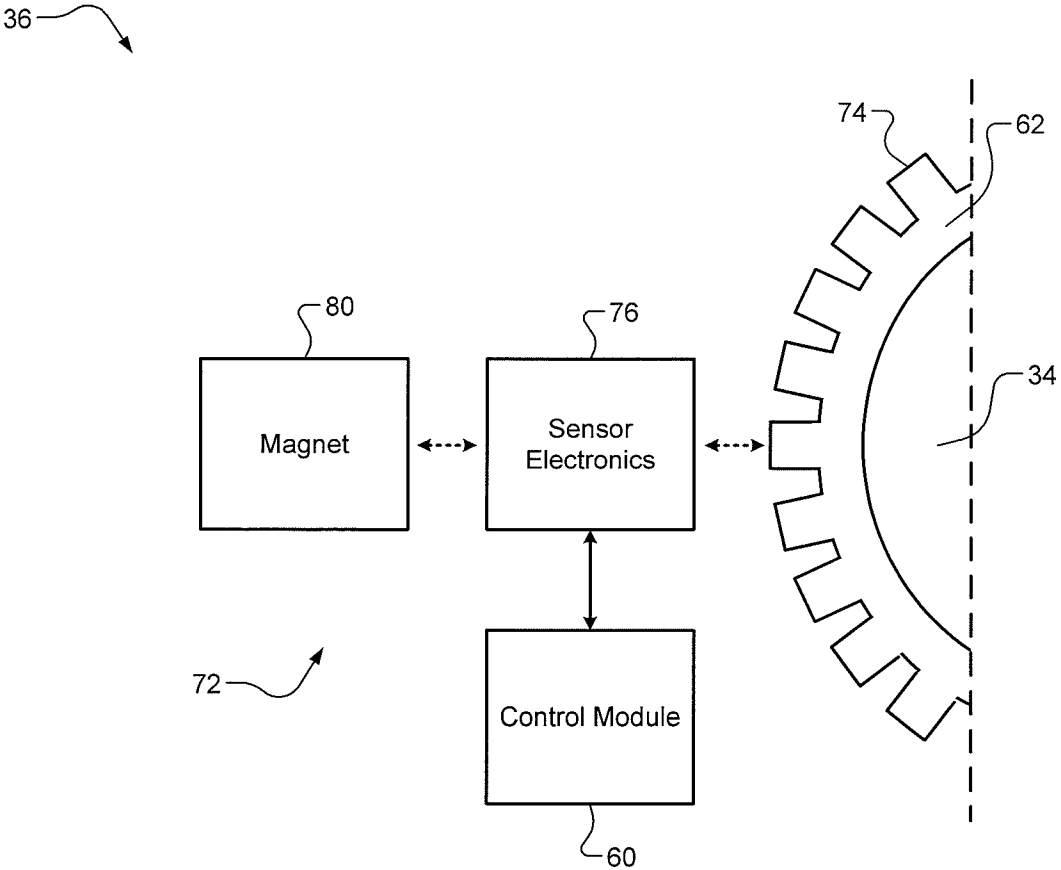
FIG. 3B is a view of an example camshaft or crankshaft position sensor according to some implementations of the present disclosure.

Referring now to FIG. 3B, an example of the camshaft position sensor 36 is shown. While the camshaft position sensor 36 is shown and described below, in some implementations the same sensor configuration described herein may be implemented for the crankshaft position sensor 44. The camshaft position sensor 36 may include a variable reluctance (VR) analog sensor 72 that detects passing of notches 74 on the camshaft gear 62 coupled to the camshaft 34. In some implementations, the VR analog sensor 72 could be used in addition to a Hall-effect or other digital output magnetic position sensor. The VR analog sensor 72 includes a magnet 80 and sensor electronics 76 that interpret/process a generated analog signal (including voltage pulses that correspond to the passing of the notches 74). The VR analog sensor 72 may output the analog signal to the control module 60 for additional processing. While notches 74 are shown and described herein, the camshaft gear 62 may include a different configuration such as teeth or magnet poles (e.g., ring magnet target wheels with alternate North-South magnet poles).

The control module 60 may determine the engine speed based on a number of pulses included in the signal during a period. The notches 74 on the camshaft gear 62 coupled to the camshaft 34 may be arranged to yield a pattern of pulses when the camshaft gear 62 is rotating. A frequency of the pulses corresponds to the engine speed. The control module 60 may also determine the position of the camshaft 34 based on the pattern of pulses detected (i.e., pattern recognition) when the camshaft gear 62 is rotating. For example, a longer notch 74 may yield a longer pulse that may indicate a position of the camshaft 34 given a predetermined camshaft-crankshaft orientation.

Figure 4:
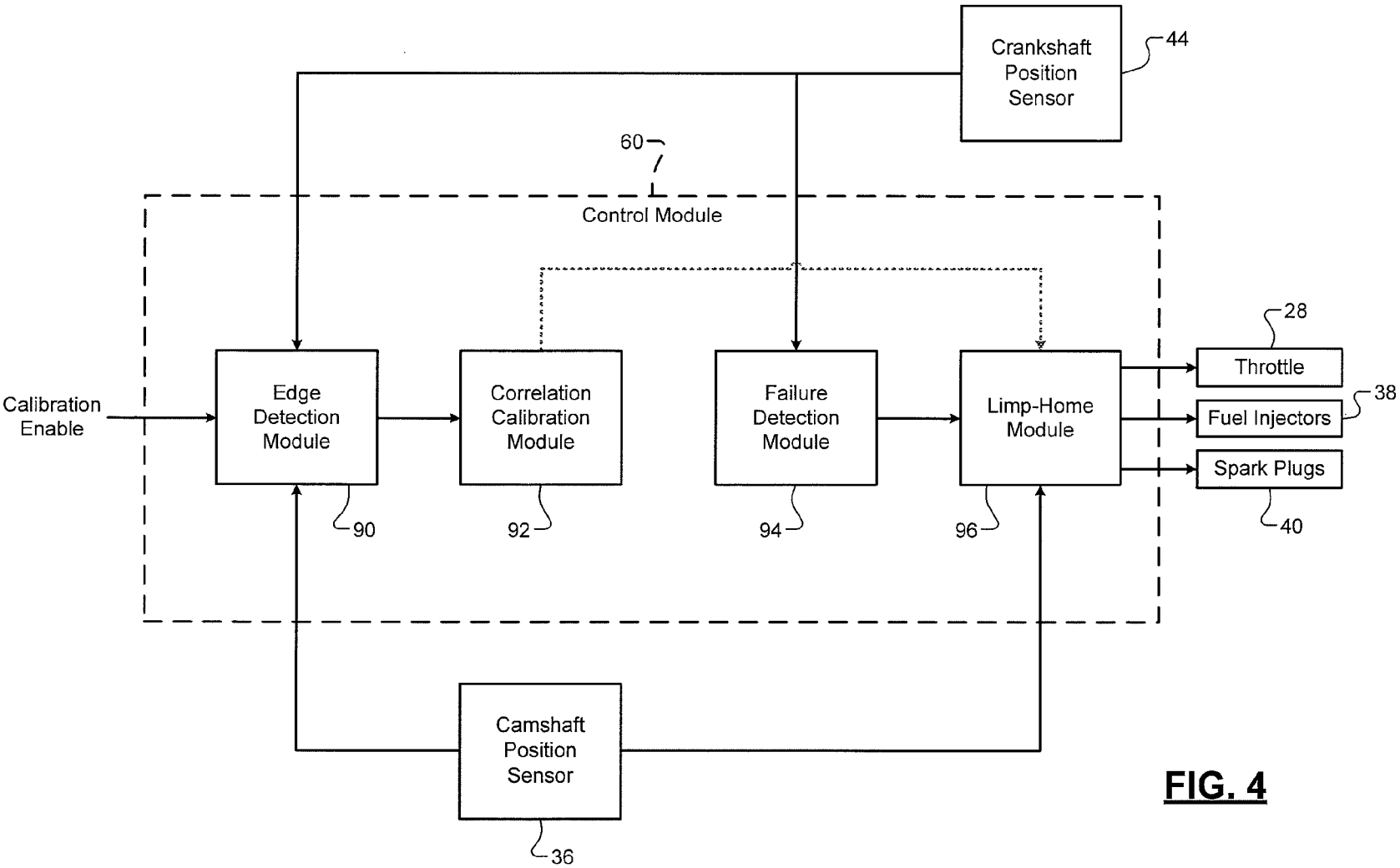
FIG. 4 is a functional block diagram of an example control module according to some implementations of the present disclosure.

Referring now to FIG. 4, an example of the control module 60 is shown. The control module 60 may include an edge detection module 90, a correlation calibration module 92, a failure detection module 94, and a limp-home module 96.

The edge detection module 90 and the correlation calibration module 92 collectively perform calibration of the engine crankshaft-camshaft correlation. More specifically, when learning conditions are met (i.e., when calibration is enabled), the edge detection module 90 may detect edges of both the camshaft 34 and the crankshaft 42 (using camshaft position sensor 36 and crankshaft position sensor 44, respectively). The learning conditions may include one or more of a plurality of suitable operating parameters (e.g., engine on, engine and/or vehicle speed greater than a threshold, etc.).

The edge detection module 90 may output corresponding signals (indicative of the edge detection) to the correlation calibration module 92. As previously mentioned, the edge detection module 90 may detect edges of notches (or teeth) of both the camshaft 34 and the crankshaft 42. Specifically, the edge detection module 90 may generate a signal when a corresponding edge is detected. For example, the edge detection module 90 may generate a periodic or square wave signal indicating detected edges as the camshaft 34 or the crankshaft 42 rotates. The edge detection module 90 may output this information (the signals) to the correlation calibration module 92.

The correlation calibration module 92 calibrates the engine crankshaft-camshaft correlation. For example, the engine 12 may initially have a predetermined crankshaft-camshaft correlation, the correlation calibration module 92 may generate a new, updated engine crankshaft-camshaft correlation. Calibrating the engine crankshaft-camshaft correlation may include determining one or more parameters of the camshaft 34 based on the edge detection(s). For example, the correlation calibration module 92 may calculate a width (e.g., in °) of a notch (or a tooth) of the camshaft gear based on a period between consecutive detected edges. The correlation calibration module 92 may also calculate a position of a particular notch (or tooth) corresponding to a predefined location on the camshaft gear. This particular notch (or tooth) may indicate a position having a predetermined relationship to the crankshaft 42.

For example only, the position may indicate a position on the crankshaft 42 given a particular camshaft-crankshaft orientation. The correlation calibration module 92 may calculate this position by measuring a plurality of notch (or teeth) widths and determining an outlier. In addition, the correlation calibration module 92 may calculate other parameters such as, but not limited to, a total number of notches (or teeth). For example, the correlation calibration module 92 may calibrate the engine crankshaft-camshaft correlation according to the method shown in FIG. 5 and described later herein.

More specifically, the correlation calibration module 92 may then calibrate the camshaft position sensor 36 based on the determined (correlated) positions on the camshaft 34 and the crankshaft 42, respectively. Depending on a configuration of the camshaft position sensor 36, calibrating the camshaft position sensor 36 may include either (i) storing the calibrated engine crankshaft-camshaft correlation for use in interpreting future measurements by the camshaft position sensor 36 (such as by the limp-home module 96, as shown) or in other cases (ii) updating predetermined parameters stored in hardware within the camshaft position sensor 36.

The failure detection module 94 detects a failure of the crankshaft position sensor 44. For example, the failure detection module 94 may detect a failure of the crankshaft position sensor 44 when the crankshaft position sensor 44 stops generating a signal. The failure detection module 94, however, may also detect a failure of the crankshaft position sensor 44 according to other suitable methods such as, but not limited to, when measurements from the crankshaft position sensor 44 are outside of predetermined limits (i.e., an expected range of operation).

Figure 6:
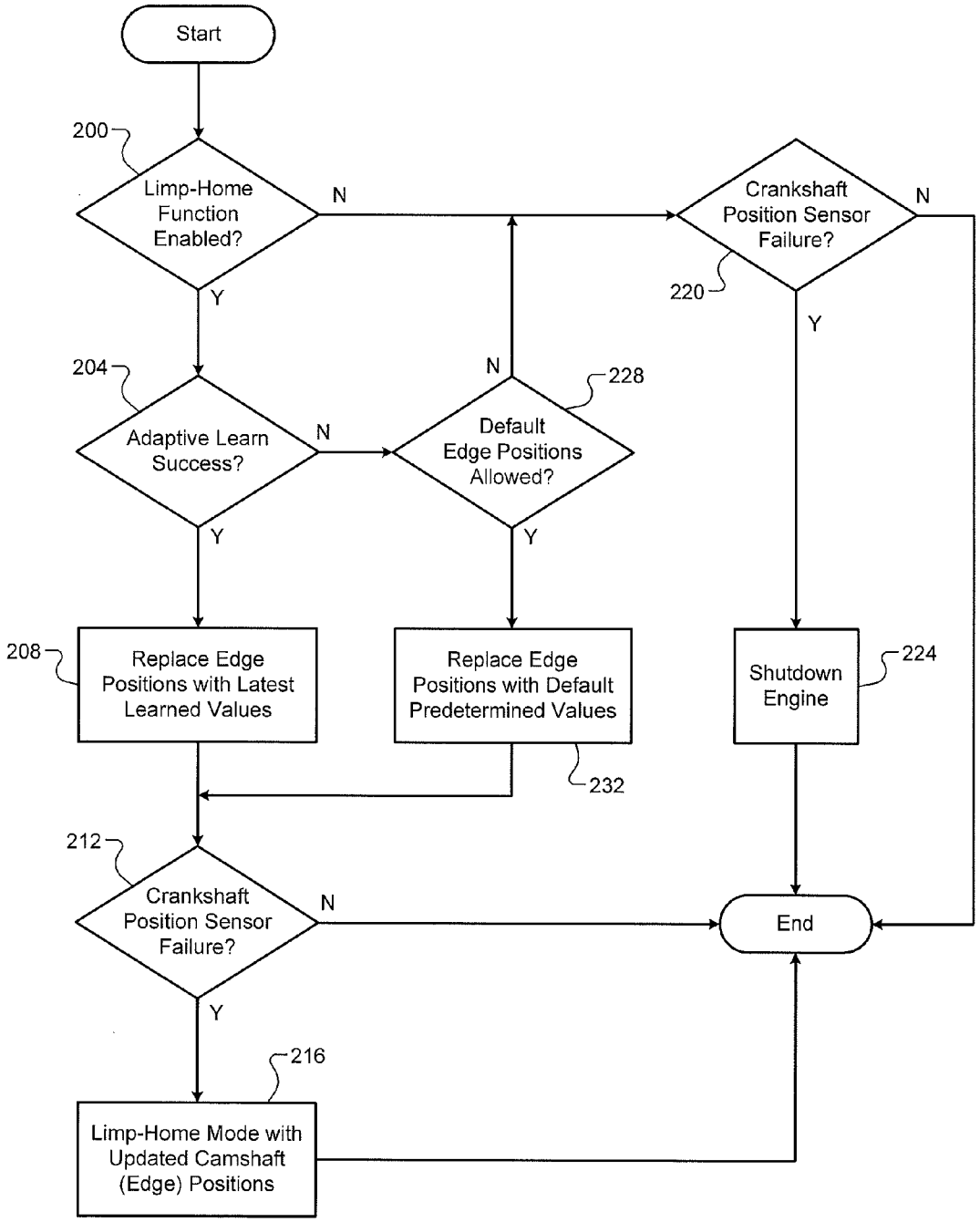
FIG. 6 is a flow diagram illustrating an example method for calibrating engine crankshaft-camshaft correlation and for improving vehicle limp-home mode according to some implementations of the present disclosure.

When the crankshaft position sensor 44 has failed, the failure detection module 94 may command limp-home mode for the vehicle. The limp-home module 96 may control limp-home mode for the vehicle by predicting crankshaft position and controlling the engine 12 accordingly. More specifically, the limp-home module 96 may predict the crankshaft position based on measured camshaft position (by camshaft position sensor 34) and the calibrated engine crankshaft-camshaft correlation. The predicted crankshaft position (in comparison to an incorrectly measured or predicted crankshaft position) may provide for more accurate fuel and/or spark delivery during limp-home mode. For example, the limp-home module 96 may control limp-home mode as shown in FIG. 6 and described later herein.

More specifically, using the predicted crankshaft position, the limp-home module 96 may control engine fuel and spark during limp-home mode by generating control signals for the fuel injectors 38 and the spark plugs 40, respectively. Additionally, the limp-home module 96 may control the throttle 28 during limp-home mode based on the predicted crankshaft position. For example only, the limp-home module 96 may lock the throttle 28 in a predetermined position during limp home mode.

Figure 5:
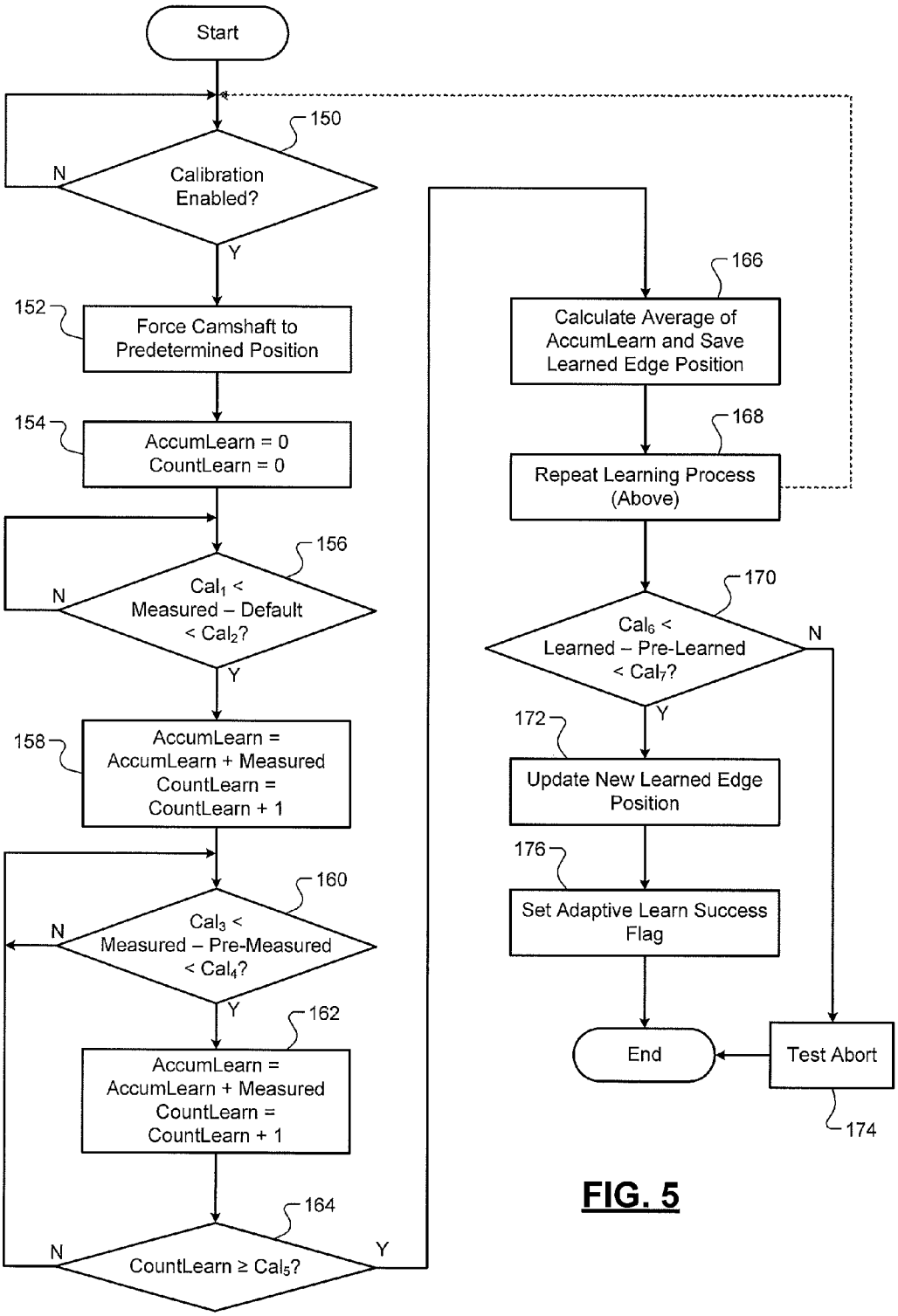
FIG. 5 is a flow diagram illustrating an example method for calibrating engine crankshaft-camshaft correlation according to some implementations of the present disclosure.

Referring now to FIG. 5, an example method for calibrating engine camshaft position measurements begins at 150. At 150, the control module 60 determines whether calibration is enabled (i.e., whether learning conditions are met). If true, control may proceed to 152. If false, control may return to 150. At 152, the control module 60 may force the camshaft 34 to a predetermined position (e.g., a park position). At 154, the control module 60 commands accumulation and counter values (AccumLearn and CountLearn, respectively) each to zero. At 156, the control module 60 determines whether a difference between measured camshaft position (by camshaft position sensor 36) and a predetermined (default) camshaft position (Default) is between first and second threshold values ($Cal_1$ and $Cal_2$, respectively). If true, control may proceed to 158. If false, control may return to 156.

At 158, the control module 60 may increment the accumulation value by the measured camshaft position and may increment the counter value by one. At 160, the control module may determine whether a difference between the measured camshaft position and a previous measured camshaft position (Pre-Measured, e.g., from a previous cycle) is between third and fourth thresholds ($Cal_1$ and $Cal_4$, respectively). If true, control may proceed to 162. If false, control may return to 160. At 162, the control module 60 again increments the accumulation value by the measured crankshaft position and may increment the counter value by one. At 164, the control module 60 determines whether the counter value is greater than or equal to a fifth threshold ($Cal_5$). If true, control may proceed to 166. If false, control may return to 160. At 166, the control module may calculate an average of the accumulation value (e.g., divided by the counter value) and then save the average as the learned edge position.

At 168, the control module 60 may repeat the learning process previously described from 150 to 166. For example, control may then return to 150. At 170, however, the control module 60 may determine whether the learning process is complete by determining whether a difference between the learned edge position (Learn) and a previous edge position (Pre-Learned, e.g., from a previous cycle) is between sixth and seventh thresholds ($Cal_6$ and $Cal_1$, respectively). If true, control may proceed to 172. If false, control may proceed to 174 where the calibration/text is aborted and control may then end. At 172, the control module 60 may update either the camshaft position sensor 36 or a corresponding memory with the new learned edge position. At 176, the control module 60 may then set an adaptive learn success flag, and control may end.

Referring now to FIG. 6, an example method for calibrating engine camshaft position measurements and improved vehicle limp-home mode begins at 200. At 200, the control module 60 determines whether the limp-home function of the present disclosure is enabled. If true, control may proceed to 204. If false, control may proceed to 220. At 204, the control module 60 may determine whether the adaptive learn procedure (shown in FIG. 5 and described above) succeeded (e.g., whether the adaptive learn success flag has been set). If true, control may proceed to 208. If false, control may proceed to 228. At 208, the control module 60 may calibrate the camshaft position sensor 36 by replacing camshaft edge position measurements with latest (i.e., most recent) adaptively learned values. At 212, the control module 60 determines whether the crankshaft position sensor 44 has failed. If true, control may proceed to 216. If false, control may end.

At 216, the control module 60 may command limp-home mode and control air/fuel/spark using updated camshaft (edge) positions. The updated camshaft (edge) positions may be either predetermined (default) positions (depending on decision 228), or the adaptively learned positions. At 220, the control module 60 determines whether the crankshaft position sensor 44 has failed. If true, control may proceed to 224 where the engine 22 may be shutdown and control may end. Similarly, if false control may end. At 228, the control module 60 determines whether predetermined (default) edge positions are allowed. If true, control may proceed to 232. If false, control may proceed to 220. At 232, the control module 60 may calibrate the camshaft position sensor 36 by replacing camshaft edge position measurements with the predetermined (default) values and control may proceed to 212.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A system for an engine, the system comprising:

an edge detection module that (i) detects edges of a camshaft of the engine using a camshaft position sensor, and (ii) detects edges of a crankshaft of the engine using a crankshaft position sensor; and a correlation calibration module that calibrates a correlation between the crankshaft and the camshaft based on an average value of measurements by the camshaft position sensor when the camshaft is in a predetermined camshaft position.

2. The system of claim 1, further comprising a failure detection module that detects a failure of the crankshaft position sensor.

3. The system of claim 2, further comprising a limp-home module that predicts crankshaft position when the crankshaft position sensor has failed based on (i) the measurements by the camshaft position sensor and (ii) the calibrated correlation.

4. The system of claim 3, wherein the limp-home module also controls at least one of (i) a throttle of the engine, (ii) fuel injectors of the engine, and (iii) spark plugs of the engine, based on the predicted crankshaft position when the crankshaft position sensor has failed.

5. The system of claim 4, wherein the correlation calibration module calibrates the correlation by calculating distances between consecutive detected edges of the camshaft.

6. The system of claim 5, wherein the correlation calibration module calibrates the correlation by determining when the camshaft is in the predetermined camshaft position based on the calculated distances.

7. The system of claim 6, wherein the first predetermined camshaft position corresponds to a predetermined crankshaft position.

8. The system of claim 7, wherein the correlation calibration module determines when the camshaft is in the predetermined camshaft position based on the calculated distances by one of (i) determining an outlier of the calculated distances and (ii) matching one of the calculated distances to a predetermined distance corresponding to the predetermined camshaft position.

9. The system of claim 7, wherein the correlation calibration module calibrates the correlation by determining an orientation of the crankshaft with respect to the camshaft based on the detection of the predetermined camshaft position and the predetermined crankshaft position.

10. The system of claim 9, wherein the correlation calibration module stores the calibrated correlation in memory to be used by the limp-home module in predicting the crankshaft position when the crankshaft position sensor fails.

11. A method for an engine, the method comprising:

detecting edges of a camshaft of the engine using a camshaft position sensor;

detecting edges of a crankshaft of the engine using a crankshaft position sensor; and calibrating a correlation between the crankshaft and the camshaft based on an average value of measurements by the camshaft position sensor when the camshaft is in a predetermined camshaft position.

12. The method of claim 11, further detecting a failure of the crankshaft position sensor.

13. The method of claim 12, further comprising predicting crankshaft position when the crankshaft position sensor has failed based on (i) the measurements by the camshaft position sensor and (ii) the calibrated correlation.

14. The method of claim 13, further comprising controlling at least one of (i) a throttle of the engine, (ii) fuel injectors of the engine, and (iii) spark plugs of the engine, based on the predicted crankshaft position when the crankshaft position sensor has failed.

15. The method of claim 14, wherein calibrating the correlation includes calculating distances between consecutive detected edges of the camshaft.

16. The method of claim 15, wherein calibrating the correlation further includes determining when the camshaft is in the predetermined camshaft position based on the calculated distances.

17. The method of claim 16, wherein the first predetermined camshaft position corresponds to a predetermined crankshaft position.

18. The method of claim 17, wherein determining when the camshaft is in the predetermined camshaft position based on the calculated distances includes one of (i) determining an outlier of the calculated distances and (ii) matching one of the calculated distances to a predetermined distance corresponding to the predetermined camshaft position.

19. The method of claim 17, wherein calibrating the correlation includes determining an orientation of the crankshaft with respect to the camshaft based on the detection of the predetermined camshaft position and the predetermined crankshaft position.

20. The method of claim 19, further comprising storing the calibrated correlation in memory to be used in predicting the crankshaft position when the crankshaft position sensor fails.

* * * * *